United States Patent [19]

Jezbera

[11] Patent Number: 4,833,981

[45] Date of Patent: May 30, 1989

[54] FIELD REPLACEABLE PRINT HAMMER

[75] Inventor: Val K. Jezbera, Thousand Oaks, Calif.

[73] Assignee: Dataproducts Corporation, Woodland Hills, Calif.

[21] Appl. No.: 644,617

[22] Filed: Aug. 27, 1984

[51] Int. Cl.[4] ..... B41J 9/10

[52] U.S. Cl. ..... 101/93.29; 101/93.48; 439/825; 439/834

[58] Field of Search ..... 101/93.29, 93.48; 339/252 R, 252 P

[56] References Cited

U.S. PATENT DOCUMENTS

| | | | |
|---|---|---|---|
| Re. 27,175 | 9/1971 | Arnold et al. | 101/93 |
| 3,145,650 | 8/1964 | Wright | 101/93 |
| 3,279,362 | 10/1966 | Helms | 101/93 |
| 3,301,177 | 1/1967 | Shepard, Jr. | 101/93 |
| 3,643,595 | 2/1972 | Helms | 101/93 |
| 3,735,698 | 5/1973 | Lenders et al. | 101/93.29 X |
| 3,747,045 | 7/1973 | Stross | 339/252 P X |
| 3,808,588 | 4/1974 | McGregor | 339/252 P |
| 3,924,921 | 12/1975 | Feightner | 339/252 P |
| 3,983,806 | 10/1976 | Ishi | 101/93.48 |
| 4,189,998 | 2/1980 | Morreall | 101/93 |
| 4,200,043 | 4/1980 | Nozaki | 101/93 |
| 4,373,440 | 2/1983 | Jezbera | 101/93.48 X |

*Primary Examiner*—David A. Wiecking
*Attorney, Agent, or Firm*—Spensley Horn Jubas & Lubitz

[57] ABSTRACT

A hammer assembly for incorporation in a hammer bank assembly useful in high-speed impact printers of the type generally employed in data processing systems is disclosed to comprise an impact tip carried on a rigid coil structure disposed in a permanent magnet field, a foot member for precisely, removably positioning the hammer assembly with respect to the hammer bank assembly, and first and second conductive spring members supporting the rigid coil structure from the foot member and, concurrently coupling the ends of the coil within the rigid coil structure to electronics associated with that particular hammer located within the impact printer. The first and second spring members serve to provide a restoring force to return a rest position within the hammer bank assembly after impact energization of the coil has been discontinued. The first and second spring members extend through the foot member and are formed to have U-shaped contact terminals on their free ends which may be removably inserted into specially adapted receptacle holes coupled appropriately with the hammer drive electronics. The first and second spring members are appropriately pre-bent to readily enable removal and insertion of the hammer assembly from and to its appropriate position within the hammer bank assembly. Appropriate segments of the extent of each of the first and second spring members are formed to have a reduced cross-sectional dimension in a plane of bending between the foot member and the specially adapted insertion holes. The insertion holes are formed to have two keyways, diametrically opposed, to receive the external shape of the arms of the U-shaped contact terminals of the spring members.

15 Claims, 3 Drawing Sheets

FIELD REPLACEABLE PRINT HAMMER

BACKGROUND OF THE INVENTION

1. Field of the Invention

This invention relates generally to improvements in hammer bank assemblies useful in high-speed impact printers of the type generally employed in data processing systems, and more particularly to an improvement in the manner of mounting one of such hammers within said hammer bank assembly.

2. Description of the Prior Art

U.S. Pat. No. 3,279,362 shows an improved hammer configuration in which a flat rigid coil structure, carrying an impact tip thereon, is supported on a pair of flexible conductive spring members for substantially rotational movement about a horizontal axis extending perpendiculr to the plane of the coil structure. The coil is disposed within the field of a permanent magnet so that when energized, a force is developed on the coil structure to rotate it from a rest position to an impact position against a character drum mounted for rotation about an axis also extending perpendicular to the plane of the coil structure. The conductive spring members return the hammer to its rest position when the coil is de-energized.

U.S. Pat. No. 3,643,595 discloses further improvement in the manner of assembling a plurality of such hammers into a hammer bank assembly. In this assembly, each of the hammer modules is mounted to the frame using a bolt. Such a device, when operated at the high printing speeds of modern line printing devices, has beern found to be subject to vibrational failure in the flexible conductive spring members and at the supporting structure of the hammer at which they are attached.

In an attempt to alleviate such high-speed vibrational difficulties, U.s. Pat. No. 4,395,945 discloses the incorporation of a foot member through which the flexible conductive spring members are passed prior to their respective terminations in a circuitry portion of the printer mechanism. The flexible conductive spring members are bonded through the foot member and the foot member is permitted a limited motion with respect to the frame of the printer assembly to enable absorption of some fo the damaging vibration resulting from high-speed printing. However, recent increases in the desired and achievable printing energy rates of such printing assemblies tend to produce vibrations within the flexible conductive spring members that approach frequencies within the ultrasonic machining range. Thus, at such higher printing energies, the high frequency vibrations in the flexible conductive spring members can be seen to significantly damage the flexible conductive spring members at their junctions with the foot member. Moreover, a significant level of the high frequency vibrations are transmitted through the foot member by the flexible conductive spring members which may often result in the breaking of one or more solder interconnections with wires attached to the flexible conductive spring members at their free ends.

SUMMARY OF THE INVENTION

It is an object of the invention to provide a hammer assembly having a reduced susceptibility to damage caused by vibrations induced by high-speed printing operation.

It is another object of the invention to provide a hammer assembly which can be replaceably installed in a hammer bank assembly without reliance on solder connections to associated circuitry.

It is a further object of the invention to provide a hammer assembly wherein flexible conductive spring elements, used to support the hammer body and to electrically couple the hammer to external circuitry, are provided with integrally formed regions of greater flexibility to enable direct interconnection of the flexible conductive spring elements to printed circuit board receptacles.

In another aspect of the invention, it is an object of the invention to provide receptacles in printed circuit boards having keyways formed therein to accept a generally U-shaped spring end of each of the flexible conductive spring members of the hammer assembly.

These and other objects of the invention which may become obvious through the detailed description hereinbelow, are achieved by providing a printing hammer assembly comprising a rigid coil structure, carrying an impact tip thereon, which is supported on a pair of flexible conductive spring members for substantially rotational movement between a rest position and an impact position when installed in a hammer bank of a high-speed printing apparatus. The coil structure is supported by first and second spring membes which are crossed and coupled to opposite sides of the rigid flat coil. The sprig members extend to a supporting block, through which they pass, maintaining their respective direction of projection. The spring members are bonded into the passages of the support block. The support block is held in position within the hammer bank assembly by a spring clip holding the support block down against a substantially cylindrical surface about which the support block may freely pivot to an engagement with a lip formed on the frame of the hammer bank assembly.

Subsequent to their respective exits from the support block, the spring members are bent so as to have a substantially parallel direction with respect to each other to enable the spring members to pass through cavities formed in the frame of the hammer bank assembly, thereby readily enabling insertion and removal of the hammer and its associate support block. A controlled extend of each of the parallel segments of the spring members is provided with a reduced cross-sectional area that minimizes the section modulus and moment of inertia in a direction of bending of the spring, yet remains within the fatigue limits of the material of the spring member. This enables each of the spring members to have a significantly increased flexibility in these segments to allow them to be directed to a common electrical bus and to a printed circuit board, respectively. The free ends of the spring members, having a full cross-sectional area, are formed into generally U-shaped configurations in the plane of the bending of the spring members.

The dimensions of the U-shaped configuration are controlled to match insert holes, including keyways, appropriately located in the common bus and the printed circuit board, respectively. For each hole, two keyways are situated 180 degrees apart with respect to each other, each having a semi-circular periphery matching the diameter of one of the spring members. The maximum dimension across the insert hole and both keyways is the equivalent to the separation between the exterior surfaces of the arms of the U-shaped configuration when the arms are partially squeezed together. By further squeezing the arms of the U-shaped configuration together, the spring member may be inserted into or removed from the keyways. Relaxation of the squeezing of the arms of the U-shaped configuration provides contact pressure between the spring members and the keyways. Insertion and removal of the U-shaped configurations to and from their respective keyways can frictionally abrade oxides formed on the surfaces of the keyways and the spring members to enhance the electrical conductivity of the contacting interconnections.

BRIEF DESCRIPTION OF THE DRAWINGS

The following description of the invention will best be understood when read in connection with the accompanying drwings, in which.

DETAILED DESCRIPTION OF THE PREFERRED EMBODIMENTS

Figure 1:
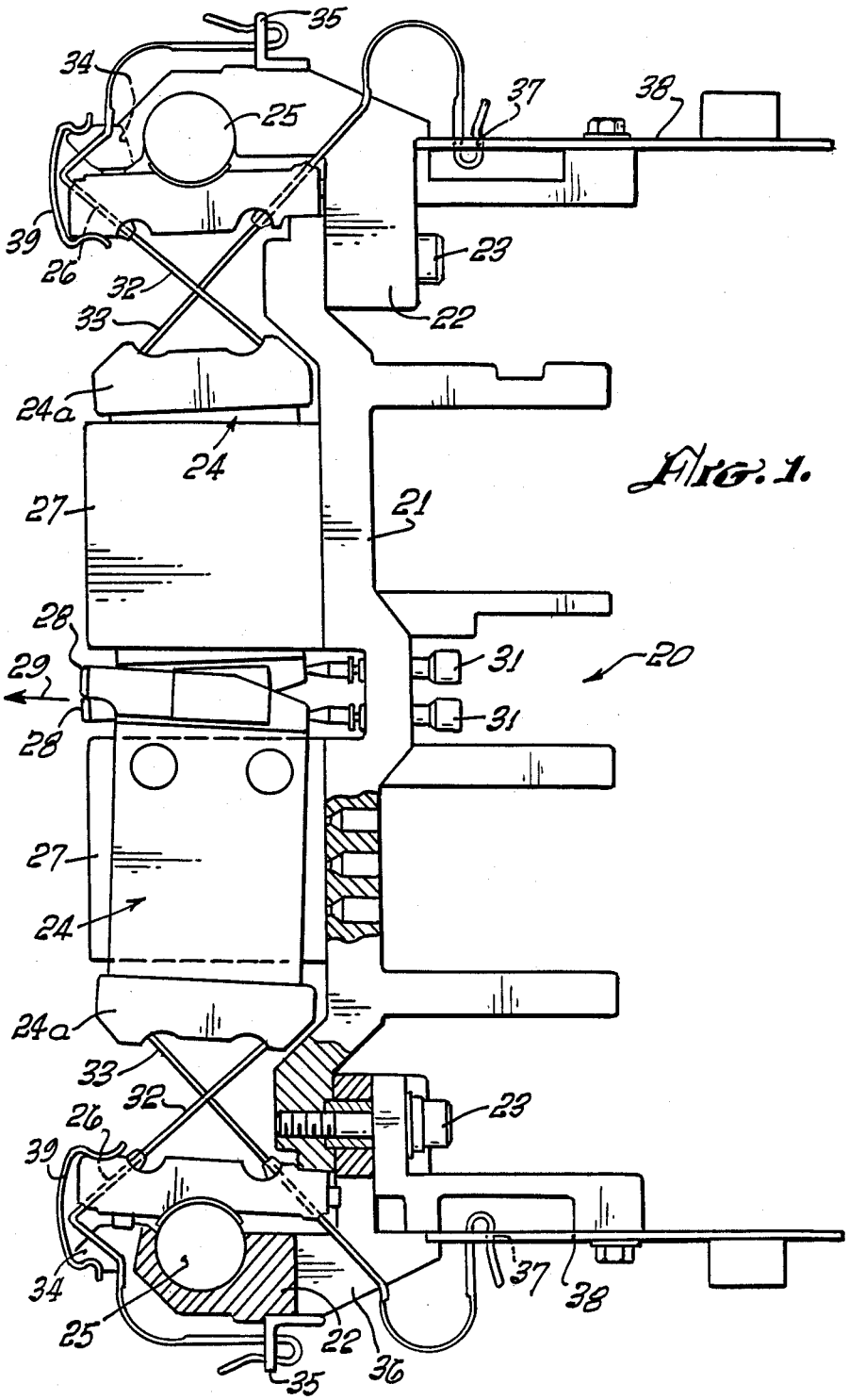
FIG. 1 is a side view of a segment of a hammer bank assembly illustrating the placement of two adjacent hammer assemblies.

Referring first to FIG. 1, a side view of a typical hammer bank indicated generally at 20 shows a frame 21 having hammer brackets 22 affixed to the upper and lower ends thereof, respectively, by bolts 23. Hammer assemblies 24 are disposed about surfaces 25 forming a part of each hammer bracket 22 such that a foot member 26 of each hammer assembly 24 rests on one or the other of the surfaces 25. The hammer assemblies 24 are disposed alternately against the upper and lower surfaces 25 in a direction perpendicular to the plane of FIG. 1. A plurality of permanent magnets 27 are affixed to the frame 21 such that they are disposed between adjacent hammer assemblies 24 resting against the same surface 25. Each hammer assembly 24 has a hammer body **24*a* with an impact tip 28 affixed to its end such that when the hamemr assembly 24 is actuated the impact tip 28 will be translated substantially in the direction indicated by the arrow 29 until it impacts with a type character (not illustrated) of the printing mechanism. The separations between, and locations of, the several hammer assemblies 24 are such that the several impact tips 28 will strike along a line on the printing mechanism running perpendicular to the plane of FIG. 1. Shock absorbers 31 are disposed on the frame 21 to absorb the return impact of the impact tips 28** are they recoil from impact against their respective type characters.

First and second spring members 32 and 33, respectively, support each hammer body **24*a* from its foot member 26. As will be more fully described below, the first and second spring members 32 and 33, respectively, are conductive and serve as the electrical conduction paths between the hammer assembly 24 and electronic circuitry associated with the printing mechanism. The spring members 32 and 33 are crossed and then passed through their associated foot member 26, witin which they are appropriately bonded. The first spring member 32 then passes through a notch 34 formed in the hammer bracket 22 at its outermost end, thus enabling the first spring member to be appropriately bent to be coupled to an electrical contact bus bar 35 forming part of the electrical circuitry of the printing mechanism. The second sring member 33 passes through a slot 36 formed in the hammer bracket 22. After passing through the slot 36, the first spring member 33 is appropriately bent to be coupled to a second contact terminal 37 located in a circuit board 38 mounted to the frame 21. The first and second spring members 32 and 33, respectively, do not contact each other throughout their extent. The foot members 26, and thus the hammer assemblies 24, are each retained in their appropriate positions against their respective surfaces 25 by spring retaining clips 39**.

Figure 2:
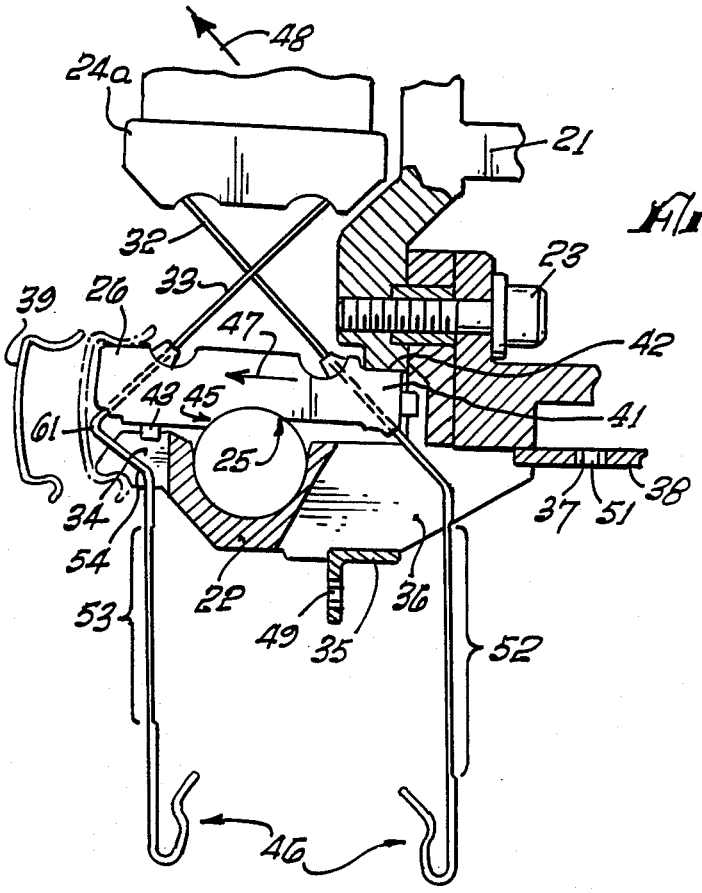
FIG. 2 is a partial sectional view of a lower portion of a hammer assembly in accordance with the present invention illustrating its insertion within a frame of the hammer bank assembly.

Referring next to FIG. 2, a fragmentary cross-sectional view will illustrate an intermediate step in the procedure for insertion of the hammer assembly 24 into its appropriate position in relation to the frame 21 and the hammer bracket 22. The illustrated right end 41 of the foot member 26 in engaged with a lip 42 formed on the end of the frame 21. A stop 43 is formed on a bottom surface of the foot member 26, near its illustrated left end, so as to engage the notch 34 located in the hammer bracket 22. A surface 45 of the foot member 26 is in matching contact with the surface 25. At this interim stage of assembly, it is important to note that the first and second spring members 32 and 33 are appropriately bent in their respective extends illustrated below the foot member 26 of FIG. 2 to have a substantially downward direction. The lowermost extremity of each of the first and second spring members 32 and 33 are appropriately bent to form substantially U-shaped contact terminals 46.

The installation of the hammer assembly 24 which includes the hammer body **24*a*, the foot member 26 and the first and second spring members 32 and 33, respectively, can best be explained, with reference to FIG. 2, by a description of the procedure for removal of the hammer assembly 24 from the assembled frame 21 and hammer bracket 22 structure. The spring retaining clip 39 is first removed from engagement with the foot member 26 and the hammer bracket 22, thereby freeing the foot member 26 for rotation and translation. The foot member 26 is then slightly pivoted in a clockwise direction about the surface 45 resting against the surface 25 which causes the end 41 of the foot member 26 to move downwardly from the lip 42 of the frame 21 within the slot 36 in the hammer bracket 22. The foot member 26 is then translated in a direction approximately that indicated by an arrow 47 until the end 41 of the foot member 26 is no longer beneath the lip 42 of the frame 21. The extent of the slot 36** in the hammer bracket 22 is sufficient to enable the lower extension of the first spring member 32 to avoid contact with the hammer bracket 22 during this translation. The hammer body 24*a*, the foot member 26, and the first and second spring members 32 and 33, respectively, may then be translated in a direction approximating that indicated by the arrow 48 until the U-shaped contact ends 46 of the first and second spring members 32 and 33, respectively, are clear of the slot 36 and notch 34, respectively, of the hammer bracket 22. Insertion of the hammer assembly 24 into the illustrated position of FIG. 2 is accomplished by a reverse procedure.

The contact bus bar 35 has a series of holes 49 formed therein, each of which is so located and adapted to be able to accept the insertion of the U-shaped end 46 of the second spring member 33 of a corresponding hammer assembly 24. The holes 49 are electrically coupled together and form an electrical return path for the circuitry of the printing mechanism. The circuit board 38 has electrical contact terminals 37 having holes 51 formed therethrough and each being adapted as to accept the insertion of the U-shaped end 46 of the corresponding first spring member 32 to complete an electrical path coupling the first spring member 32 to an electronic circuit (not illustrated) associated with that particular hammer assembly 24. The first spring member 32 has a narrowed segment 52, located downwardly from the illustrated downward bend of the first spring member 32 and extending to a point above the U-shaped end 46. Similarly, the second spring member 33 has a narrowed segment 53 similarly placed in its downward extension. The lengths of the narrowed segments 52 and 53 are not necessarily equal.

Figure 3:
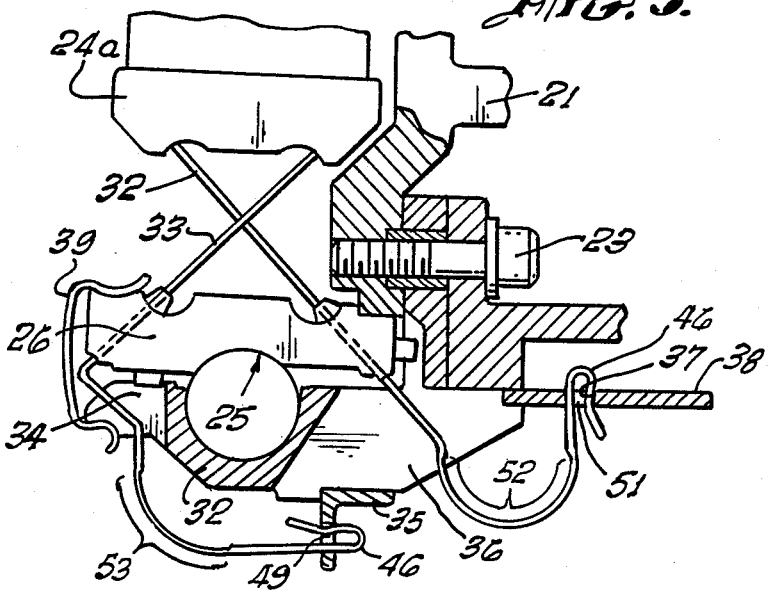
FIG. 3 is a partial sectional side view of a hammer assembly in accordance with the present invention illustrating the manner of coupling the electrical circuitry.

Referring next to FIG. 3, the installation of the hammer assembly 24 into the frame 21 and hammer bracket 22 structure is completed by appropriately placing the spring retaining clip 39 over retaining surfaces formed in the projections of the hammer bracket 22 forming the notch 34 and the foot member 26, thereby retaining the foot member 26 in its installed position. The downward extension of the first spring member 32 is flexed through the segment 52 so that the U-shaped end 46 is inserted through the hole 51 in the contact terminal 37 of the circuit board 38. Similarly, the second spring member 33 is flexed, in its downward extension, through the segment 53 so that the U-shaped end 46 of the second spring element 33 is inserted into the hole 49 of the contact bus bar 35.

The hammer body 24*a* has an appropriate flat coil (not illustrated) disposed therein. This coil has its terminations coupled to the ends of the first and second spring members 32 and 33, respectively, embedded in the hammer body 24*a*. Thus, when electronic circuitry associated with the particular hammer assembly 24 illustrated in FIG. 3 is appropriately activated to provide a signal directing the particular hammer assembly 24 to impact a type character of the printing machine, an electrical current is provided from the electronics on the circuit board 38 to the contact terminal 37 and hole 51 and thus to the U-shaped end 46 of the first spring member 32. The current then flows through the first spring member 32, through the coil within the hammer assembly 24, and to the second spring member 33, which conducts the current to the U-shaped end 46 inserted in the hole 49 of the contact bus bar 35. This electrically couples the return signal back to the electronicis and its associated power source. When, in this manner, current flows through the coil within the hammer body 24*a*, a magnetic field is created which interacts with the permanent field of the magnet 27 (FIG. 1), thereby causing the hammer body 24*a* to rotate to its impact point. During this rotation, those portions of the first and second spring members 32 and 33, respectively, located between the hammer body 24*a* and the foot element 26 are flexed from their rest positons. When the electrical current through the coil within the hammer body 24*a* is discontinued, the hammer body 24*a* is returned to its rest position through an unflexing action of the first and second spring members 32 and 33.

Figure 4:
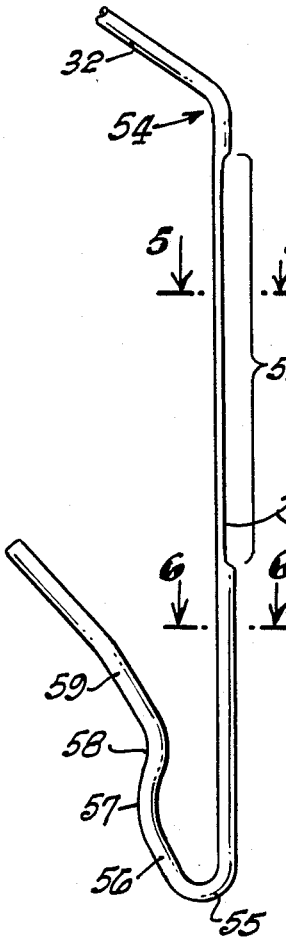
FIG. 4 is a partial side view of a lower end of the right spring member of FIG. 2.
Figure 5:
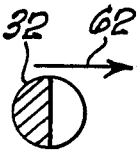
FIG. 5 is a cross sectional view of the spring member taken along the plane 5—5 of FIG. 4.
Figure 6:
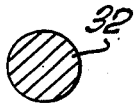
FIG. 6 is a cross sectional view of the spring member taken along the plane 6—6 of FIG. 4.

Referrng next to FIG. 4, as an example of the narrowed segments of the spring members 32 and 33, the lower portion of the spring member 32, as shown in FIG. 2, is presented in an enlarged view. A first bend 54 is formed in the spring member 32 at an appropriate distance below the foot member 26 (FIG. 2). A narrowed segment 52 is disposed at appropriate distance from the bend 54. The free end of the spring member 32 is then bent, in the same plane as the bend 54, to form the U-shaped end 46 by making a second bend 55 to an angle slightly less than 180 degrees to provide for locking of the U-shaped end 46 into one of the electrical contact holes, as will be more fully described below. A third bend 57, a fourth bend 58, and a fifth bend 59 are formed, in the plane of the bends 54 and 55, to create a contact seat and locking segment at an appropriate position. FIG. 5 and FIG. 6 are transverse cross-sectional views of the first spring member 32 taken in the narrowed segment 52 and in a full cross-sectional area, respectively.

The U-shaped ends 46 of each of the first and second spring members 32 and 33 are formed in a manner substantially similar to that described above. However, referring briefly to FIG. 2, it will be noted that the second spring member 33 includes a sixth bend 61 of approximately 90 degrees located between the foot member 26 and the first bend 54. Additionally, the second spring member 33 has its U-shaped end 46 formed as a mirror image of that formed in the first spring member 32. As previously stated, all of the bends are co-planar.

Referring next to FIG. 5, the preferrd form of the cross-section of the first spring member 32 in the narrowed segment 52 (FIG. 4) is illustrated to be substantially in the shape of a hemi-circle. Subsequent flexure of the first spring member 32 to enable it to be inserted into its contact terminal hole is preferred to be in the direction indicated by an arrow 62, which is also illustrated as an arc in FIG. 4. Such a shape may be produced by forming or mechanical abrasion of the segment 52 to reduce its cross-section from that illustrated in FIG. 6.

Figure 7:
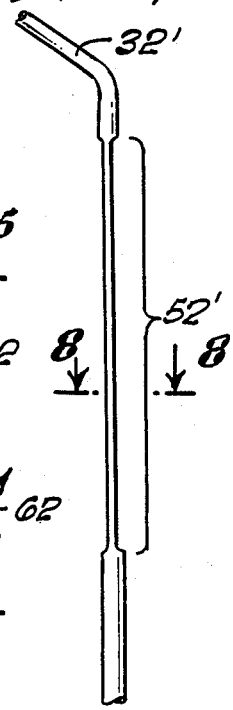
FIG. 7 is a partial side view of an alternate embodiment of a spring member in accordance with the present invention.
Figure 8:
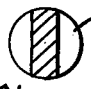
FIG. 8 is a cross sectional view of the spring member taken along the plane of 8—8 of FIG. 7.

Referring next to FIG. 7, an alternate embodiment of the narrowed segment of the first spring member 32′ is indicated generally at 52′. FIG. 8 illustrates that the transverse cross-sectional area in the segment 52′ is that of a central cord of a circle representing the full area of the first spring member 32′. Such a cross-sectional area may be formed by chemically etching or mechanically abrading both sides f the first spring member 32′. All similar narrowed segments in each of the first and second spring members may be formed in this manner.

Figure 9:
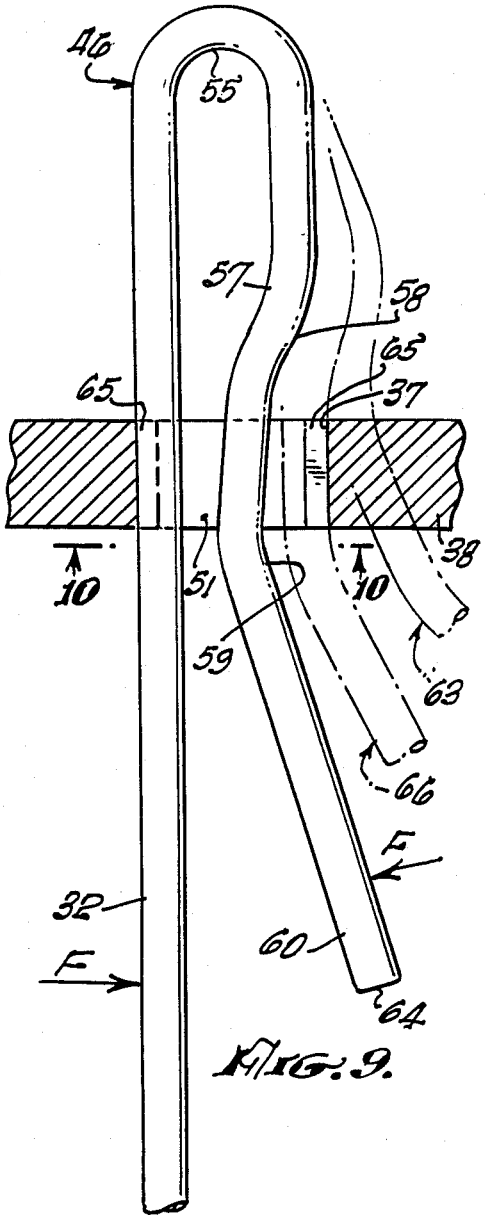
FIG. 9 is an enlarged partial cross sectional view illustrating the insertion of a spring member in an insert hole in accordance with the present invention.

Referring next to FIG. 9, the manner of insertion of a representative first spring member 32 into a representative hole 51 in an electrical contact 37 and a circuit board 38 is illustrated. When the U-shaped end 46 of the first spring member 32 is to be inserted into the hole of 51, force is applied to the free end 60 of the first spring member 32 and the main segment of the first spring member 32 in a manner indicated by the arrows labeled "F" in FIG. 9. Starting in a fully unflexed position, indicated by the broken line image in position 63, representing the configuration of the U-shaped end 46 prior to insertion into the hole 51, application of the force "F" may flex the U-shaped end 46 of the spring member 32 to a position 64, wherein the maximum transverse dimension of the U-shaped end 46 is less than the diameter of the hole 51 plus that of a pair of keyways 65 formed within the hole 51. After the U-shaped end 46 has been inserted into the hole 51 and keyways 65, removal of the force "F" allows the second bend 55 to unflexed until the U-shaped end 46 assumes the position indicated by the broken line image at position 66. When appropriately inserted into the position 66, the surfaces of the first spring member 32 and that portion of the U-shaped end 46 located between the fourth bend 58 and the fifth bend 59 will be substantially parallel with the surfaces of the hole 51 and keyways 65 formed in the circuit board 38. That portion of the U-shaped end 46 between the third bend 57 and the fourth bend 58 thus projects to a maximum dimension in the plane of the bend that is greater than the combined diametric dimension of the hole 51 and the two keyways 65, thereby precluding the inadvertent removal of the U-shaped end 46 from the hole 51. Similarly, the fifth bend 59 provides that the free end 62 of the U-shaped end 46 will have a dimension in the plane of the bends greater than the combined dimension of the hole 51 and the keyways 65, thereby precluding the U-shaped end 46 from being inserted in the hole 51 more than a designed extent.

Figure 10:
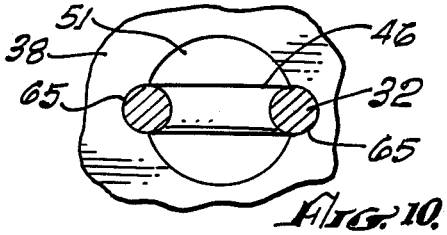
FIG. 10 is a plan view of an insert hole in accordance with the present invention taken along the plane of 10—10 of FIG. 9.

Referring next to FIG. 10, which illustrates a representative hole 51 in a circuit board 38, together with a cross-section of the first spring member 32 inserted therein, as indicated in FIG. 9, it can be seen that the hole 51 has a substantially circular shape as is typically formed in standard machining operations. The keyways 65 are formed through the circuit board 38 in positions that are diametrically opposed to each other. The shape of the keyways 65, formed in the walls of the hole 51, are substantially equivalent in size and shape to approximately one-half of the cross sectional size and shape of the first spring member 32. This matching of size and shape of the keyways 65 to the spring member 32 provides for substantial physical contact therebetween to enhance electrical conductivity between the spring member 32 and an electricaly conductive coating plating the inner walls of the hole 51 and keyways 65. Insertion and removal of the U-shaped end 46 into the hole 51 and keyways 65 will tend to abrade the surfaces of the keyways 65 and the spring member 32 so as to enhance the electrical conductivity through the surfaces of contact. The preferred fabrication process recommended is to first form the keyways 65 into the circuit board 38 by drilling a pair of holes spaced appropriately apart. The hole 51 may then be drilled into the circuit board 38 so as to be centered on a line between the centers of the holes forming the keyways 65. The holes 49 in the contact bus bar 35 are formed in an identical manner.

While I have described a preferred embodiment of the invention hereinabove, numerous modifications, substitutions, changes, variations of materials, and alternate embodiments are envisioned by the inventor, and may be obvious to those skilled in the art. Such alternative configurations and embodiments are intended by the inventor to be within the purview of his invention as determined by the scope of the appended claims.

I claim:

1. A field replaceable print hammer for use in a hammer bank assembly, comprising:
   - a body having an energizing coil located therein:
   - a pair of crossed spring members extending from the body and connected to the coil;
   - a foot member, through which said spring members extend, securing the print hammer in a hammer bank assembly; and
   - an electrical connector integrally formed at an end of each spring member detachably connecting, in a manually mainpulable manner, the spring members to electronic circuitry associated with the hammer bank assembly.

2. A field replaceable print hammer as claimed in claim 1, wherein each of said pair of crossed spring members further comprises an integrally formed length having a reduced cross-sectional area, said length of reduced cross-section being disposed between said foot member and said connector integrally formed at the end of the spring member, said length of reduced cross-section a area having an extent sufficient to establish a radius of bending enabling the connection of said connector to said electronic circuitry.

3. A field replaceable print hammer as claimed in claim 1, wherein each of said electrical connectors comprises a terminal length of the spring member bent to form a substantially U-shaped spring.

4. A hammer bank assembly for use in a printing mechanism, comprising:
   - a frame;
   - a plurality of field replaceable print hammers, each comprising:
     - a body having an energizing coil located therein, said coil producing a first magnetic field in response to an energizing current;
     - a pair of crossed spring members extending from the body and connected to the coil;
     - a foot member, through which said spring members extend, securing the print hammer to said frame; and
     - a pair of electrical connectors, integrally formed at the end of the spring members, respectively;
   - means for exstablishing a second magnetic field adapted to interact with said first magnetic field; and
   - a plurality of electronic circuits mounted on said frame and controllably providing energizing current to said coils, said electronic circuits being provided with receptacles, each adapted to receive and retain one of said spring connectors.

5. The hammer bank of claim 4 wherein the spring members have lengths of reduced cross-sectional area providing a reduced bending modulus, wherein the spring members may be bent through a radius to engage the electrical connectors with the electronic circuit receptacles.

6. The hammer bank assembly of claim 4 wherein each of the electrical connector spring member ends form substantially U-shape springs with at least three additional bends, formed in the plane of the U-shape, forming a seating region bounded by a pair of locking surfaces.

7. A hammer bank assembly as claimed in claim 6, wherein said receptacles are each formed, in a circuit board of said circuits, as a hole having a pair of diametrically opposed keyways extending radially outwardly in the circumference of the hole, said keyways adapted to receive one of said substantially U-shaped spring connectors such that the arms forming the U-shape are within the keyways and are urged into contact therewith by a self-springing action of said U-shaped spring connector.

8. In a print hammer for use in a printing machine, wherein the print hammer is electrically coupled to electronics of the printing machine by a pair of conductive spring members extending through an element supporting the print hammer, the improvement wherein:

each of said conductive spring members has a substantially U-shaped electrical coupling spring terminal integrally formed at its end; and each of said conductive spring members has a portion between said element supporting the print hmmer and the electrical coupling spring terminal having a reduced cross-sectional area thereby to have a reduced bending modulus to facilitate coupling of said coupling terminal to electronics associated with said printing machine.

9. The print hammer of claim 8 wherein each of the spring members has a portion with a reduced cross-sectional area, between the print hammer support element and the U-shaped electrical coupling end, providing a reduced bending modulus facilitating connection of the electrical couplings to the electronics.

10. In a hammer bank assembly of a printing machine, wherein a plurality of printing hammers are mounted on a frame, each of said printing hammers being supported by a pair of spring members, electrically coupled to its printing hammer and extending through a foot member to be electrically coupled to controlling electronics mounted on said frame, the improvement comprising:

a pair of holes formed in a circuit board holding the controlling electronics of the printing hammer, said holes each having a pair of diametrically opposed keyways formed outwardly in its circumference, said holes being conductively plated and appropriately coupled to said electronics;

a substantially U-shaped spring electrical contact terminal integrally formed on the end of each spring member for insertion into the appropriate one of said holes; and a length of each spring member, disposed between said foot member and its contact terminal, having a reduced cross-sectional area providing a bending modulus substantially below that of the spring member and facilitating bending of the spring member through a radius to enable the contact terminal to be inserted in the appropriate hole.

11. A print hammer for use in a hammer bank assembly having associated print hammer activating electronic circuitry, comprising:

a hammer body having an energizing coil;

a foot member securing the hammer body to the hammer bank assembly; and a pair of spring members, extending from the hammer body and through the foot member, each having an end formed into a detachable electrical connector providing a conducting path from the associated electronic circuitry to the hammer body coil.

12. The print hammer of claim 11 wherein the associted electronic circuitry includes a plurality of apertures having electrically conducting edges and wherein the electrocal connector spring member ends each have a generally U-shape retainingly insertable into the apertures.

13. The print hammer of claim 11 wherein each of the sprng members has a portion, between the foot member and the U-shaped ends, with a reduced cross-sectional area providing said portions with a reduced bending modulus.

14. A hammer assembly as claimed in claim 13 wherein said length of reduced cross-sectional area has a semi-circular cross-section.

15. A hammer assembly as claimed in claim 13, wherein said length of reduced cross-sectional area has a cross-sectional shape bounded by a pair of generally parallel chords of a circle and a pair of arcs between said chords.

* * * * *